US005934874A

United States Patent [19]

Hall et al.

[11] Patent Number: 5,934,874

[45] Date of Patent: Aug. 10, 1999

[54] COOLABLE BLADE

[75] Inventors: Kenneth Hall, Gainsville, Ga.; Bernhard Weigand, Waldshut-Tiengen, Germany

[73] Assignee: Asea Brown Boveri AG, Baden, Switzerland

[21] Appl. No.: 08/916,789

[22] Filed: Aug. 25, 1997

[30] Foreign Application Priority Data

Aug. 23, 1996 [DE] Germany ..... 196 34 237

[51] Int. Cl.[6] ..... F01D 5/18

[52] U.S. Cl. ..... 416/92; 416/97 R

[58] Field of Search ..... 415/115; 416/92, 416/96 R, 96 A, 97 R

[56] References Cited

U.S. PATENT DOCUMENTS

| | | | |
|---|---|---|---|
| 3,171,631 | 3/1965 | Aspinwall | 416/97 R |
| 3,427,001 | 2/1969 | Malley et al. | 416/97 R |
| 5,536,143 | 7/1996 | Jacal et al. | 416/96 R |
| 5,695,321 | 12/1997 | Kercher | 416/97 R |

FOREIGN PATENT DOCUMENTS

| | | | |
|---|---|---|---|
| 1247072 | 8/1967 | Germany . | |
| 1601627 | 5/1970 | Germany . | |
| 364747 | 3/1973 | U.S.S.R. | 416/96 A |
| 2165315 | 4/1986 | United Kingdom . | |

*Primary Examiner*—Christopher Verdier
*Attorney, Agent, or Firm*—Burns, Doane, Swecker & Mathis, L.L.P.

[57] ABSTRACT

A coolable blade (10) essentially comprises a blade root (11) and a blade body (1), which is composed of a pressure-side wall (6) and a suction-side wall (5). They are connected to one another essentially via a trailing-edge region (4) and a leading-edge region (3) in such a way that at least one hollow space (2) used as a cooling-fluid passage is formed. An essentially radially running, diverging cooling passage (7) is arranged in the trailing-edge region (4).

4 Claims, 2 Drawing Sheets

COOLABLE BLADE

BACKGROUND OF THE INVENTION

1. Field of the Invention

The invention relates to a coolable blade.

2. Discussion of Background

GB 2 165 315 discloses coolable blades. There, cooling fluid is directed from the trailing-edge region of the blade to the leading-edge region via turns formed by dividing walls and is then expelled via openings in the blade head. In order to adequately cool the trailing-edge region of the blade, air is expelled from the trailing edge of the blade. For production reasons, however, this method cannot be used in the case of trailing edges having small radii. In addition, in order to cool the trailing edge, a large number of film-cooling holes are necessary, which makes the manufacture of the blade very expensive. Furthermore, the expulsion of air at the trailing edge may lead to a reduction in the aerodynamic efficiency of the blade, since a larger trailing-edge radius is required. DE 1 601 627 likewise discloses a cooled blade which has at its trailing-edge region a radially running cooling passage diverging toward the blade tip. The cooling passage is fed with cooling air via a larger inlet opening. In this case, the cross-sectional area of this cooling passage is approximately the same size as that of the main passage in the blade center and even larger than that of the main passage in the region of the blade tip. The heat-transfer rates in the trailing-edge region of the blade are therefore not better than those in the center part of the blade, and adequate cooling of the trailing-edge regions of the blade can no longer be ensured in the case of a blade subjected to high thermal loading.

SUMMARY OF THE INVENTION

Accordingly, one object of the invention, in the case of a coolable blade of the type mentioned at the beginning, is to improve the cooling of the trailing-edge region of the blade and achieve a high aerodynamic efficiency of the blade.

The essence of the invention is therefore that an essentially radially running cooling passage which becomes larger in area with increasing radius and is connected to the hollow space via an inlet opening is arranged in the trailing-edge region, and that the cooling passage is connected to the hollow space via at least one connecting passage.

The advantages of the invention may be seen, inter alia, in the fact that cooling fluid directed through the cooling passage is expelled from the blade in the region of the blade head and therefore has no effect on the aerodynamics of the blade. Furthermore, small trailing-edge radii can be realized, since cooling fluid does not have to be expelled at the trailing-edge of the blade. Effective cooling of the trailing-edge region of the blade is achieved due to the divergent configuration of the cooling passage. Cooling of local zones can readily be set by the configuration of the divergent passage. In addition, in the case of moving blades having cover plates, the top region toward the blade head, where there is a high risk of creep, can be cooled in an especially effective manner.

With the use of the divergent cooling passage, considerably less cooling air is required than, for example, in the case of film cooling of the trailing edge. In addition, blades having the diverging cooling passage can be manufactured by the casting process.

It is advantageous to connect the cooling passage to the hollow space via at least one connecting passage. The connecting passages between the hollow space and the cooling passage act as suction points for cooling air from the hollow space and intensify the heat transfer in the trailing-edge region of the hollow space. The cooling fluid enters the cooling passage radially through the connecting passages and produces extremely high coefficients of heat transfer.

Further advantageous developments of the invention follow from the further subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a blade of fluid-flow machine, wherein.

DESCRIPTION OF THE PREFERRED EMBODIMENTS

Figure 1:
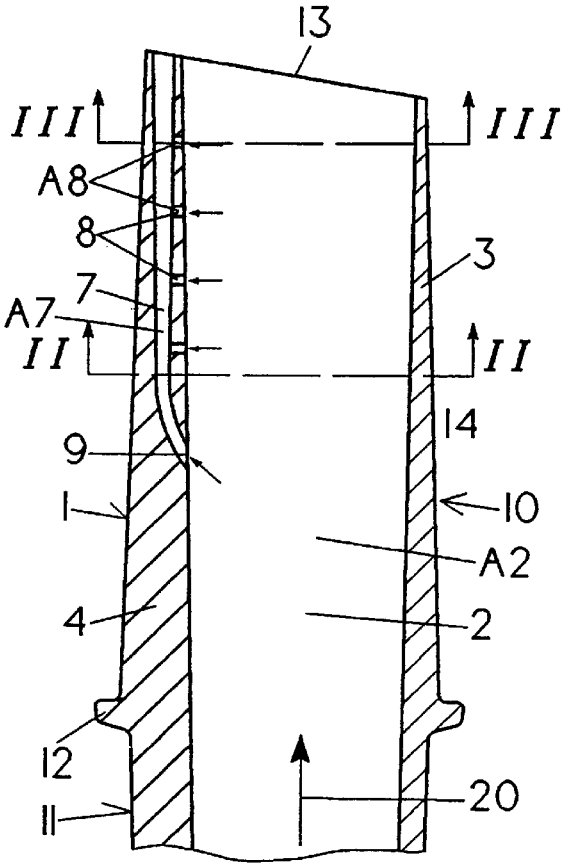
FIG. 1 shows a partial longitudinal section through the blade.
Figure 2:
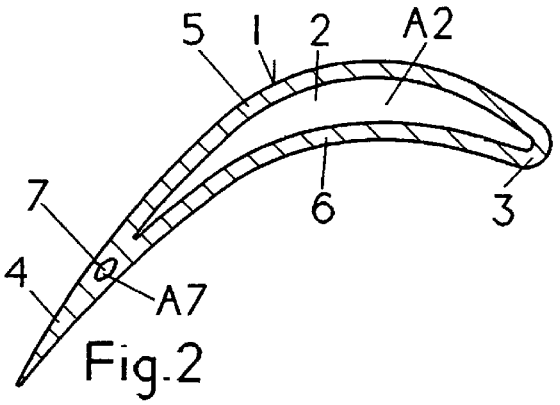
FIG. 2 shows a partial cross section through the blade along line II—II in FIG. 1.

Referring now to the drawings, wherein like reference numerals designate identical or corresponding parts throughout the several views and only the elements essential for understanding the invention are shown, in FIGS. 1 and 2 a blade 10 of a fluid-flow machine is shown, consisting of a blade body 1 and a blade root 11, with which the blade 10 can be mounted. A platform 12 is normally arranged between blade body 1 and blade root 11, which platform 12 shields the blade root from the fluids flowing around the blade body. The blade body 1 has a leading-edge region 3, a trailing-edge region 4, a suction-side wall 5 and a pressure-side wall 6, the suction-side wall and the pressure-side wall being connected to one another in the region of the leading edge 3 and the trailing edge 4, as a result of which a hollow space 2 having a cross-sectional area A2 is formed. The fluids flowing around the blade body 1 are first admitted in each case to the leading-edge region 3. The hollow space 2 runs essentially in radial direction through the blade 10 and serves as a cooling-fluid passage for a cooling fluid.

Arranged in the region of the trailing edge 4 is a radially running cooling passage 7 which has a cross-sectional area A7 and diverges in the direction of flow toward a blade head 13 of the blade 10. In this case, the cooling passage 7 may be configured in particular as a diffuser. Not shown is that the diverging cooling passage 7 can particularly in the region of the blade head 13 be parallel. The cooling passage 7 is connected to the hollow space 2 via connecting passages 8 having a cross-sectional area A8 and via an inlet opening 9 in a blade-body center region 14. Not shown is the fact that the inlet opening 9 of the cooling passage may also be arranged at any location, for example closer to the blade root or in the blade root. Normally, however, the cooling passage 7 will be arranged in the downstream part of the blade approximately starting from the center 14 of the blade body, since the loading and the risk of creep are greatest there.

Cooling fluid 20 flows through the hollow space 2 and via the inlet opening 9 and the connecting passages 8 into the cooling passage 7. The flow circulation is thereby agitated in the hollow space 2 in the region of the trailing edge. Heated cooling fluid, which tends to stick in the region of the trailing edge on account of the locally increased friction, is thereby mixed with cooler cooling fluid, specifically also with the cooling fluid entering the cooling passage 7.

The trailing-edge region is cooled by the cooling fluid directed through the cooling passage 7, the coefficient of heat transfer in the cooling passage 7 increasing from the blade-body center toward the blade head. This is due to the increasing mass flow of cooling fluid in the cooling passage 7, which is effected by the further feeding of cooling fluid via the connecting passages 8. This increases the cooling of the blade-body head 13.

The flow circulation in the trailing-edge region of the hollow space as well as the cooling capacity of the trailing-edge region can be set by the design of the cooling passage, the inlet opening and the connecting passages. In addition, the divergence angle of the cooling passage is adapted to the number of connecting passages from the hollow space in such a way that the cooling of the blade is optimal.

In this arrangement, the cross-sectional area A8 of the connecting passages 8 is smaller than the cross-sectional area A7 of the cooling passage 7 and the cross-sectional area A7 in turn is much smaller than the cross-sectional area A2 of the hollow space 2 (A8<A7<<A2). In this case, A8 to A2 is preferably a few percent, in particular 1–5%; A8 to A7 is preferably several tens percent, in particular 30–100% and A7 to A2 is preferably several percent, in particular 1–10%.

Due to the geometry selected, the flow velocity of the fluids through the connecting passages as well as in the diffuser passage 7 is much greater than that in the cooling passage A2.

By appropriate design of the cross sections A8, A7 and A2, the effect is achieved that the flow velocity of the fluids in the cooling passage 7 remains approximately the same or increases slightly with increasing radius.

Figure 3:
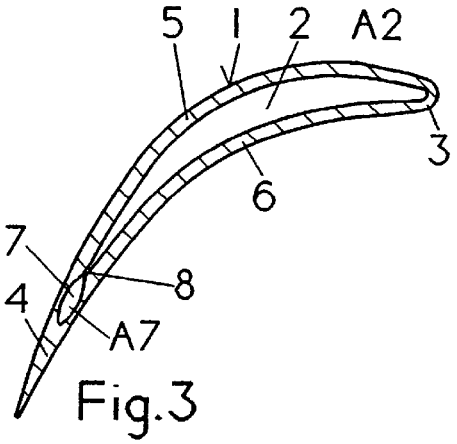
FIG. 3 shows a partial cross section through the blade along line III—III in FIG. 1.

The increase in the cross-sectional area of the cooling passage 7 toward the blade head 13 as well as the connecting passage 8 is shown in FIG. 3.

A Nusselt number Nu is defined as the ratio of the convectively dissipated heat quantity to the conducted heat quantity. Here, the Nusselt number of the cooling passage $Nu_{cooling\ passage}$ is several times higher than the Nusselt number in a smooth hollow space (A2) $Nu_{hollow\ space}$. Thus, for example, it has been established by experiment that $Nu_{cooling\ passage}/Nu_{hollow\ space}=10–15$.

Figure 4:
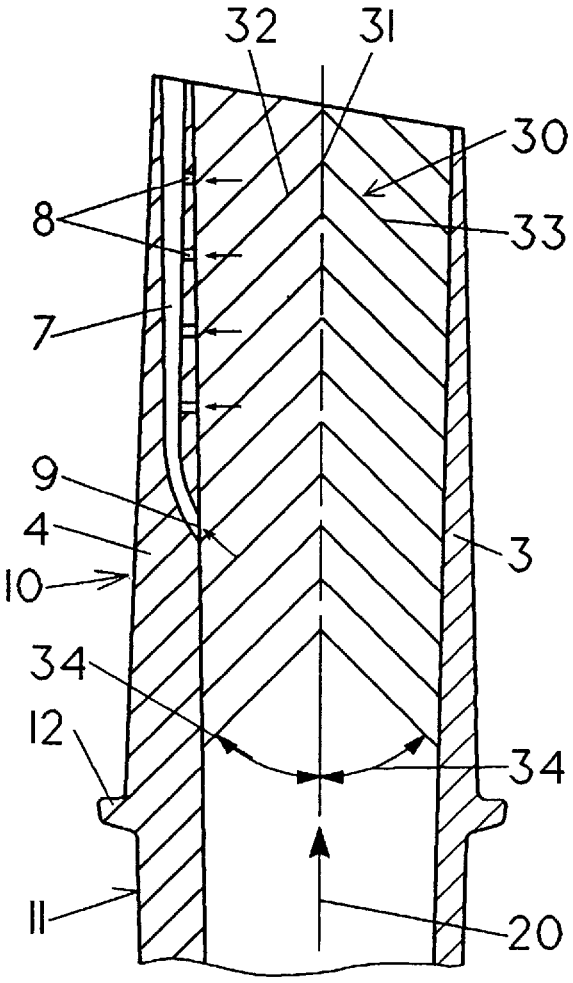
FIG. 4 shows a partial longitudinal section through a further blade according to the invention.

In FIG. 4, V-shaped ribs 30 having an apex 31 and legs 32, 33 are arranged in the hollow space 2 on the suction-side wall 5. In this arrangement, the legs of the ribs are bent at an angle 34 to the main flow direction of the cooling fluid 20. In this case, the angle 34 is 30 to 60°, preferably 40 to 50°, and in particular 45°. The ratio of rib height to hollow-space height is essentially the same at each point of the rib and lies between 5 and 50%. The apex of the rib 30 is arranged at the point where the rib height is at a maximum. In the regions where the hollow space 2 merges into the leading- and trailing-edge region, the rib 30 narrows in order not to inhibit the passage of the cooling-fluid in these regions.

The ribs (not shown) arranged on the inside of the pressure-side wall 6 are likewise V-shaped. The apex likewise lies at the point where the rib height is at a maximum. The ribs are arranged offset from one another in the direction of flow on the pressure- and suction-side wall, so that the flow successively strikes a rib 30 of the suction side 5 and a rib of the pressure side 6. The ribs are in each case advantageously arranged in the center between the ribs of the opposite wall. Cooling of the blade is ensured by the ribs in combination with the cooling passage 7, which cooling leads to a uniform distribution of the wall temperature.

Figure 5:
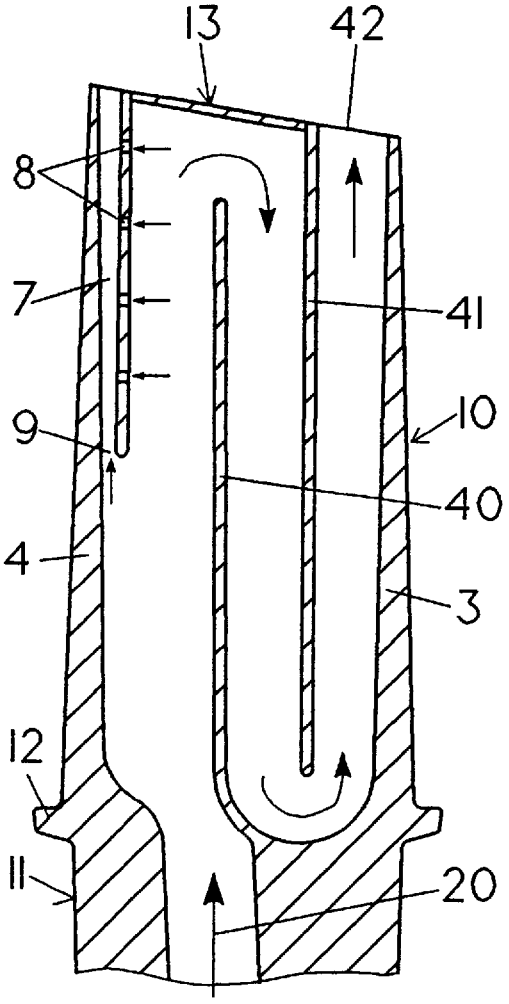
FIG. 5 shows a partial longitudinal section through a further blade according to the invention.

FIG. 5 shows a further possible configuration of the hollow space 2, as disclosed, for example, by GB 2 165 315 mentioned at the beginning. Here, the cooling fluid 20 is directed from the trailing-edge region of the blade to the leading-edge region via turns formed by dividing walls 40, 41 and is then expelled via an opening 42 in the blade head 13. Here, too, a diverging cooling passage 7 for cooling the trailing-edge region is arranged in the trailing-edge region.

The invention is of course not restricted to the exemplary embodiment shown and described. The configuration of the hollow space and thus of the cooling-fluid passage may also be effected in a manner different from that shown, for example as a plurality of individual cooling passages. What is essential is the design of the diverging cooling passage in conjunction with the connecting passages between diffuser and main passage. The cross-sectional areas A2, A7 and A8 are in each case measured perpendicularly to the direction of flow of the fluids flowing through the hollow spaces.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A coolable blade, comprising:

a blade root;

a blade body comprising a pressure-side wall, a suction-side wall, a trailing-edge, a leading-edge, and a blade head opposite said blade root, said pressure-side wall and said suction-side wall being connected to one another by said trailing-edge and said leading-edge to form at least one hollow space in said blade body for use as a cooling-fluid passage;

a diverging cooling passage in said trailing-edge, said diverging cooling passage including a trailing edge side, an inlet opening at a blade body end of said diverging cooling passage, and an outlet opening at a blade head end of said diverging cooling passage, said diverging cooling passage extending substantially radially between said inlet opening and said outlet opening and being substantially closed along said trailing edge side, said inlet opening fluidly communicating said at least one hollow space with said diverging cooling passage; and at least one connecting passage located between said inlet opening and said blade head, said at least one connecting passage fluidly communicating said diverging cooling passage with said at least one hollow space;

wherein when cooling fluid is allowed to flow through said at lest one hollow space toward said blade head, a first portion of said cooling fluid flows through said inlet opening into said diverging cooling passage, and a second portion of said cooling fluid flows through said at least one connecting passage into said diverging cooling passage, said first and second portions cooling said trailing edge before exiting said diverging cooling passage through said outlet opening.

2. The coolable blade in accordance with claim 1, wherein said diverging cooling passage comprises a diffuser.

3. The coolable blade in accordance with claim 1, wherein said diverging cooling passage extends at least from a center region of said blade body up to said blade head.

4. The coolable blade in accordance with claim 1, further comprising a main flow direction for the cooling fluid through said at lest one hollow spaces, and at least one rib in said at least one hollow space, said at least one rib comprising an apex and two legs and wherein said rib legs are bent at an acute angle relative to said cooling fluid main flow direction.

* * * * *